US006766545B2

(12) United States Patent
Hodges

(10) Patent No.: US 6,766,545 B2
(45) Date of Patent: Jul. 27, 2004

(54) SHOWER DRAIN

(76) Inventor: B. Eugene Hodges, 761 Palmer Dr., Greenville, MI (US) 48838

( * ) Notice: Subject to any disclaimer, the term of this patent is extended or adjusted under 35 U.S.C. 154(b) by 0 days.

(21) Appl. No.: 10/065,423

(22) Filed: Oct. 16, 2002

(65) Prior Publication Data

US 2003/0159211 A1 Aug. 28, 2003

Related U.S. Application Data

(60) Provisional application No. 60/360,098, filed on Feb. 27, 2002.

(51) Int. Cl.[7] ..... E03C 1/12

(52) U.S. Cl. ..... 4/679; 4/288; 285/42; 285/208; 210/164

(58) Field of Search ..... 4/252.4, 252.5, 4/252.6, 288, 613, 679; 285/139.1, 142.1, 205, 206, 208, 308, 412, 42, 136.1; 210/163, 164, 165

(56) References Cited

U.S. PATENT DOCUMENTS 412,195 A * 10/1889 Marker ..... 4/288 X
984,259 A * 2/1911 Beck ..... 4/288 X
1,686,498 A * 10/1928 Parker ..... 285/412
2,221,803 A * 11/1940 Krobusek ..... 285/412 X
3,322,442 A * 5/1967 Flachbarth ..... 285/208
3,680,153 A 8/1972 Haldopoulos et al.
4,850,617 A 7/1989 Moberly ..... 4/288 X
6,192,532 B1 2/2001 Sesser et al.

* cited by examiner

*Primary Examiner*—Robert M. Fetsuga

(57) ABSTRACT

A shower drain having a tapered body and arcuate keepers circumferentially disposed around the body and capable of being drawn up the tapered body from a lower position to a higher position to engage the underside of a shower drain floor and hold the drain in place. When the keepers are in the lower position the drain readily fits through the floor drain opening. The keepers are drawn up the body by turning bolts extending through openings in the drain flange. The keepers extend substantially the full circumference of the drain body to provide maximum seating area against the underside of a shower floor.

12 Claims, 6 Drawing Sheets

SHOWER DRAIN

CROSS REFERENCE TO RELATED APPLICATIONS

This patent claims the benefit of U.S. Provisional Patent Application No. 60/360,098, filed Feb. 27, 2002.

BACKGROUND OF INVENTION

This patent relates to shower drains. More particularly, this patent relates to a shower drain having adjustable arcuate keepers that engage the underside of the shower floor to hold the drain securely in place.

Shower drains are used to connect the upper end of a shower drainpipe to the shower floor. Shower drains typically comprise a hollow cylindrical plastic body portion and a metal cover grate or strainer. The drain is positioned on the pipe so that the cover grate is flush with the shower floor.

Sesser et al. U.S. Pat. No. 6,192,532 discloses a shower drain replacement device comprising four wings (32) that snug up against the underside of the shower floor upon rotating four screws. While the Sesser replacement drain may be suitable for its intended purpose, the narrow upper surface of the wings provides a relatively small surface area for engaging the underside of the shower floor, which can result in slippage and leaking, especially with thinner lead shower floors. The present invention addresses this potential problem by providing a shower drain having wide, circumferentially disposed, arcuate keepers that snug up against a large surface area of the shower floor underside, providing a secure fit.

Thus a primary object of the present invention is to provide a shower drain having members that engage the underside of the shower floor around substantially the entire circumference of the drain body, thereby minimizing the possibility of leakage between the drain and the floor.

Another object of the invention is to provide a shower drain that is relatively inexpensive to manufacture and easy to install.

SUMMARY OF INVENTION

The present invention is a shower drain with arcuate keepers that extend around substantially the full circumference of the drain body and mate with the underside of a shower floor to provide a secure, watertight connection. In one embodiment the drain comprises a plastic body, four arcuate keepers connected by living hinges to form a ring, four pairs of nuts and bolts, and a metal cover grate. The plastic body has a substantially cylindrical downstream portion, a tapered upstream portion, and a flange portion extending outward from the top periphery of the tapered portion. The flange has holes for accommodating the bolts.

Each keeper extends a little less than one quarter of the way around the cylindrical body. Each bolt extends through an opening in the flange and then through an opening in one of the keepers. A nut is threaded onto the end of each screw and brought up inside a similarly configured bore located on the underside of each keeper.

To install, the shower drain is inserted into an opening in the floor of a shower. The bolts are then turned, which causes the keepers to move axially upward until they are snug against the underside of the shower floor. The tapered portion of the shower drain body guides the keepers outward so they make better contact with the shower floor. As each keeper is drawn up the tapered portion of the body, the living hinges spread out, helping guide the keepers up the outside of the tapered body portion. Plumber's putty or silicone may be applied to the underside of the flange to form a watertight seal between the flange and the shower floor. The shower drain may be used as an original installation item or as a replacement drain.

DETAILED DESCRIPTION

Figure 1:
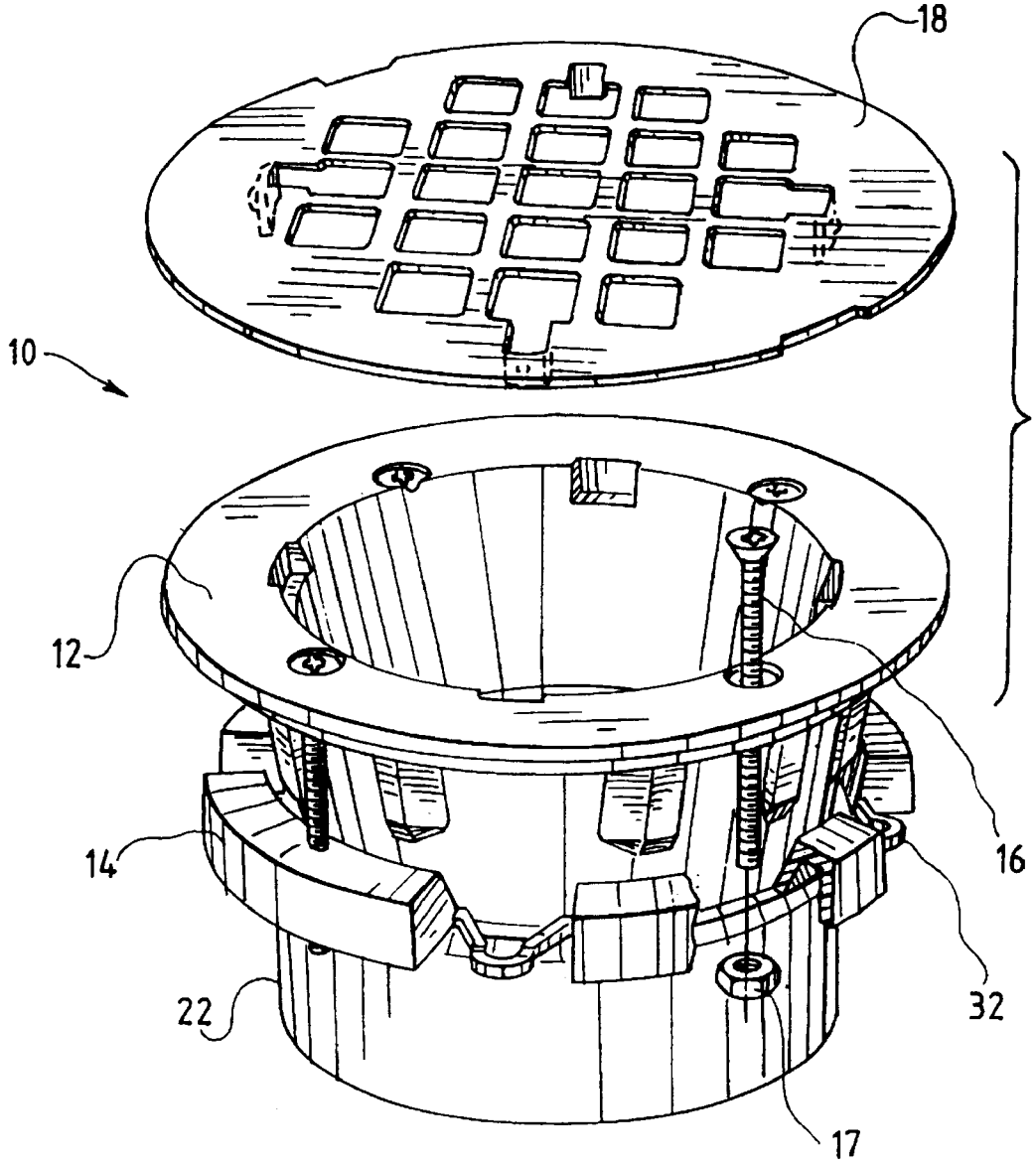
FIGS. 1 and 1A are perspective views of the preferred embodiment of the shower drain of the present invention, including the drain body, keeper ring, nuts and bolts, and cover grate.
Figure 1A:
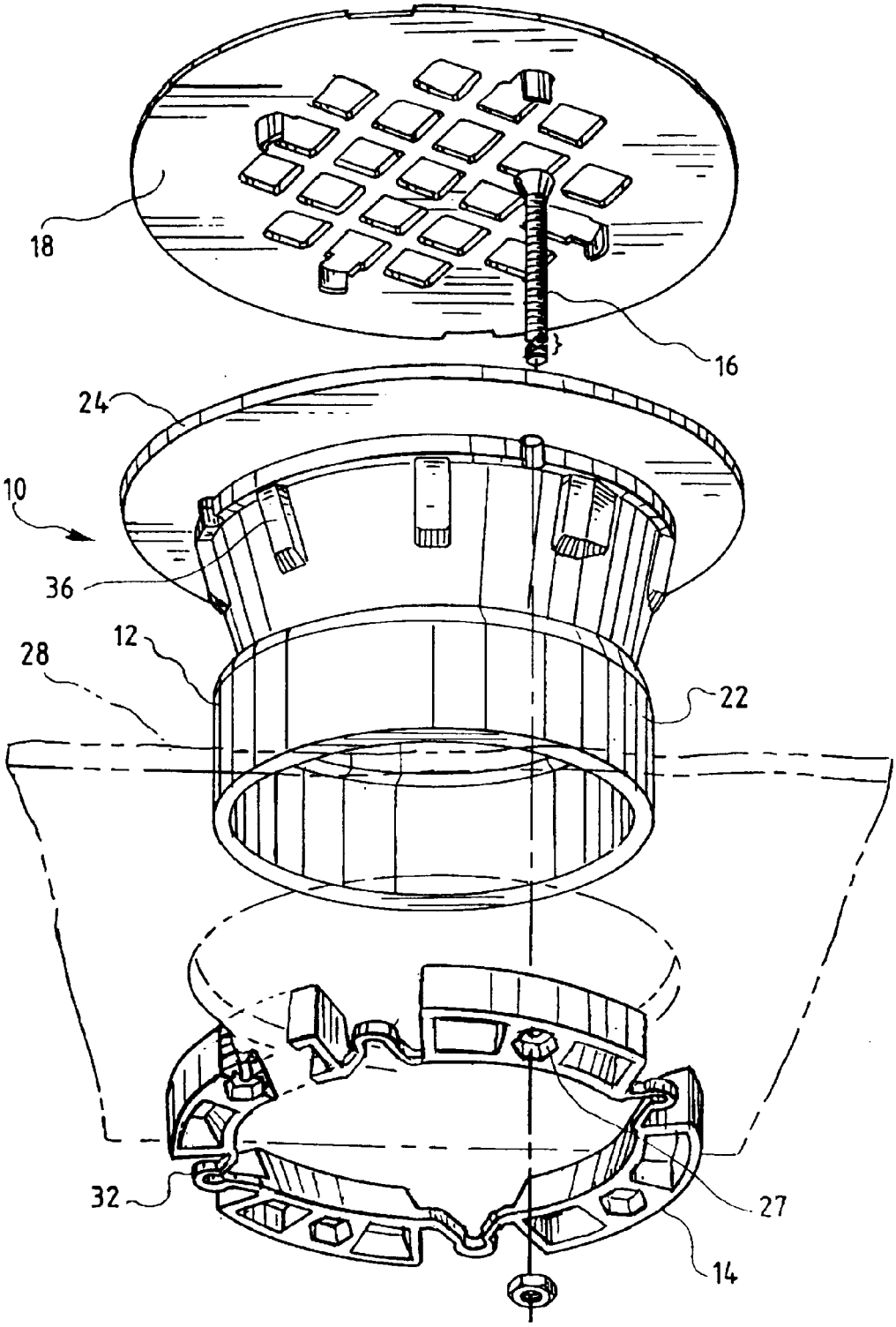

Turning to the drawings, there is shown in FIGS. 1 and 1A the preferred embodiment of the present invention, a shower drain 10 having circumferentially-disposed, arcuate keepers 14 for securing the drain to the underside of a shower floor 28. The shower drain 10 comprises a hollow body portion 12, arcuate keepers 14, adjusting screws or bolts 16 with nuts 17, and a cover grate or strainer 18.

Figure 2:
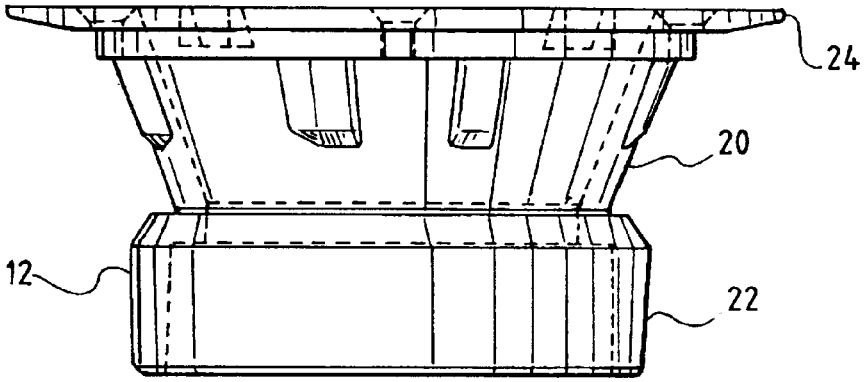
FIG. 2 is a side elevational view of the drain body of FIG. 1.
Figure 4:
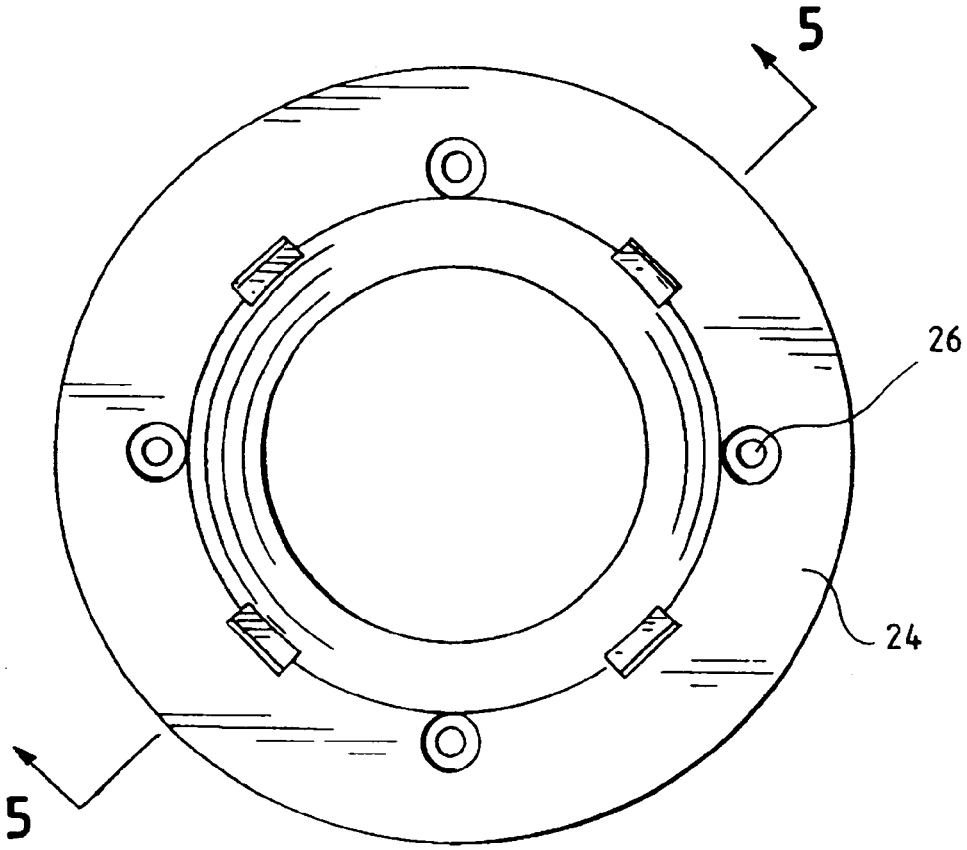
FIG. 4 is a top plan view of the shower drain body.

As perhaps best shown in FIG. 2, the body 12 comprises a tapered (upstream) portion 20, a substantially cylindrical (downstream) portion 22 having an internal bore for accommodating the drain pipe (not shown), and a flange 24 extending peripherally outward from the top (upstream) end of the body 12 for seating on a floor or other fitting. Apertures 26 disposed in the flange 24 (FIG. 4) accommodate the adjusting bolts 16. The nuts 17 are threaded onto the ends of the bolts 16 and brought up inside a similarly configured bore 27 located on the underside of each keeper 14.

Figure 3:
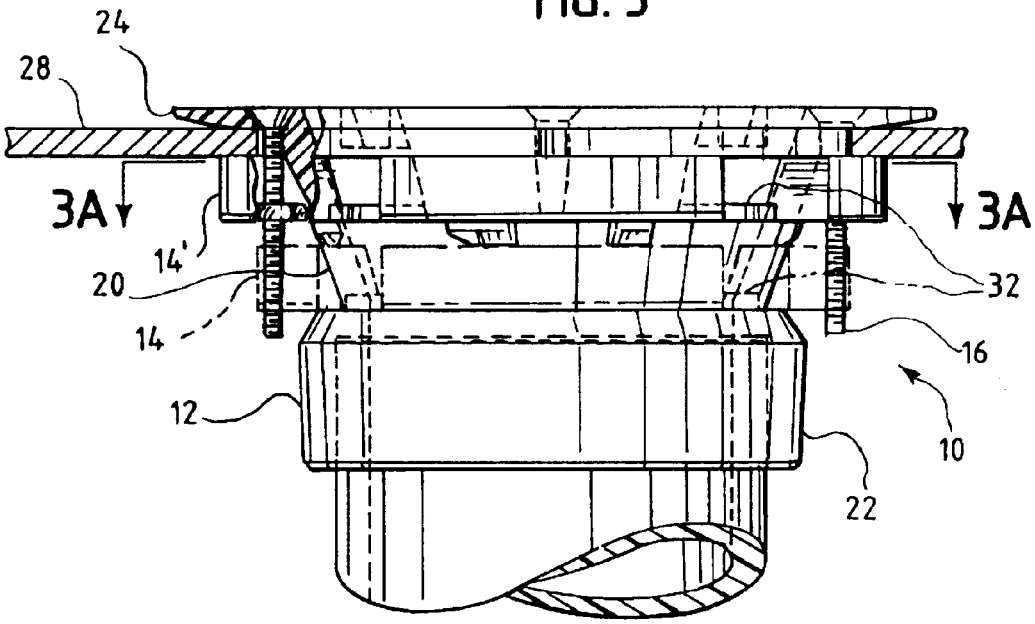
FIG. 3 is a side elevational view of the shower drain of FIG. 1, with the keeper ring in a lower (uninstalled) position shown in phantom lines and the keeper ring in a raised (installed) position shown in solid lines.

As shown in FIG. 3, the upstream portion 20 of the drain body 12 is tapered. As the keepers 14 are drawn up the body 12, the keepers move from a lower position 14, indicated by phantom lines, to a higher position 14', indicated by solid lines. In the lower position 14, the keeper ring has a diameter small enough to fit through the opening in the floor 28. In the higher position 14', the keeper ring has a relatively larger diameter that allows the keepers to engage the underside of the floor 28.

Figure 3A:
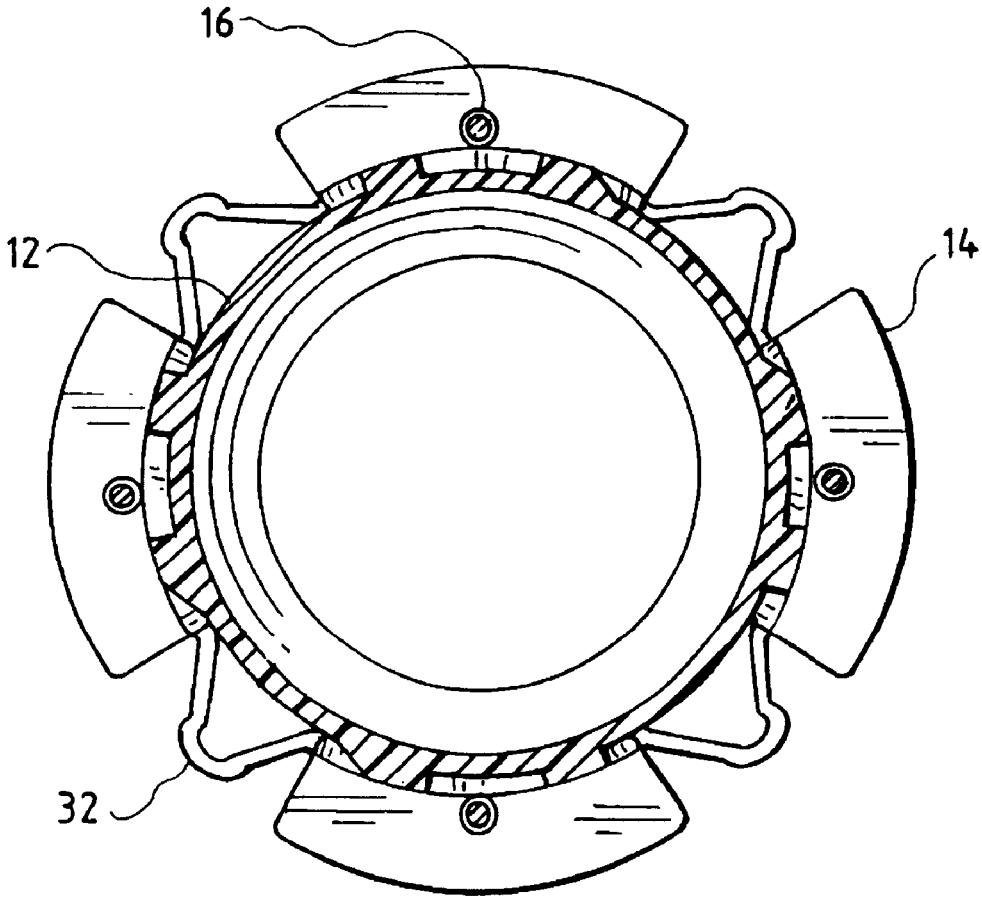
FIG. 3A is a cross sectional view of the shower drain of FIG. 3 taken along line 3A—3A.

FIG. 3A is a cross sectional view of the shower drain of FIG. 3 taken along line 3A—3A. Each keeper 14 extends around almost a quarter of the way around the circumference of the drain body 12 and has a flat upper surface, thus providing a large area of contact between the keepers 14 and the underside of the shower floor.

Figure 5:
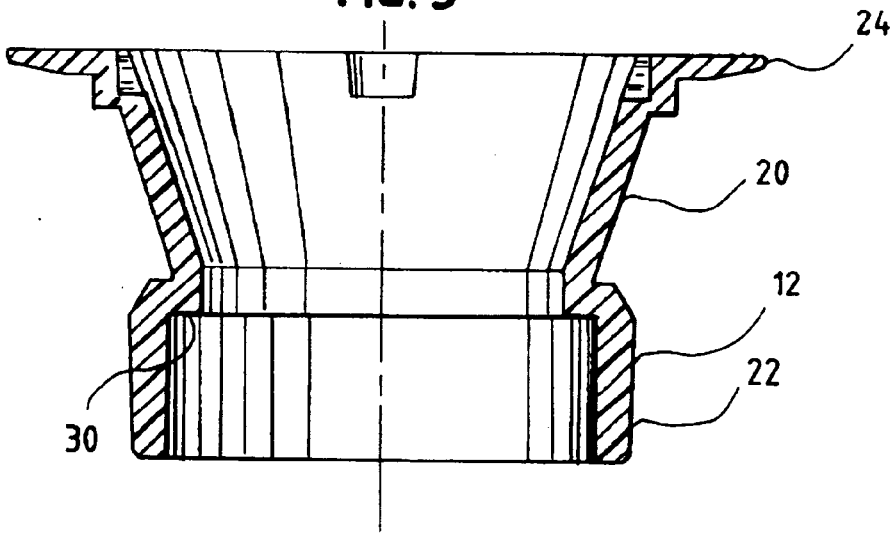
FIG. 5 is a cross-sectional view of the shower drain body taken along line 5—5 of FIG. 4.

FIG. 5 is a cross-sectional view of the drain body 12. The upstream portion 20 of the drain body 12 tapers inward from top to bottom and terminates in an optional lip or stop 30 that abuts a drain pipe (not shown) when the drain body 12 is installed. Alternatively, the body 12 may have a smooth, constant diameter inner bore so that the drain can be completely slid over the pipe and adjusted across a wide range of heights.

Figure 6:
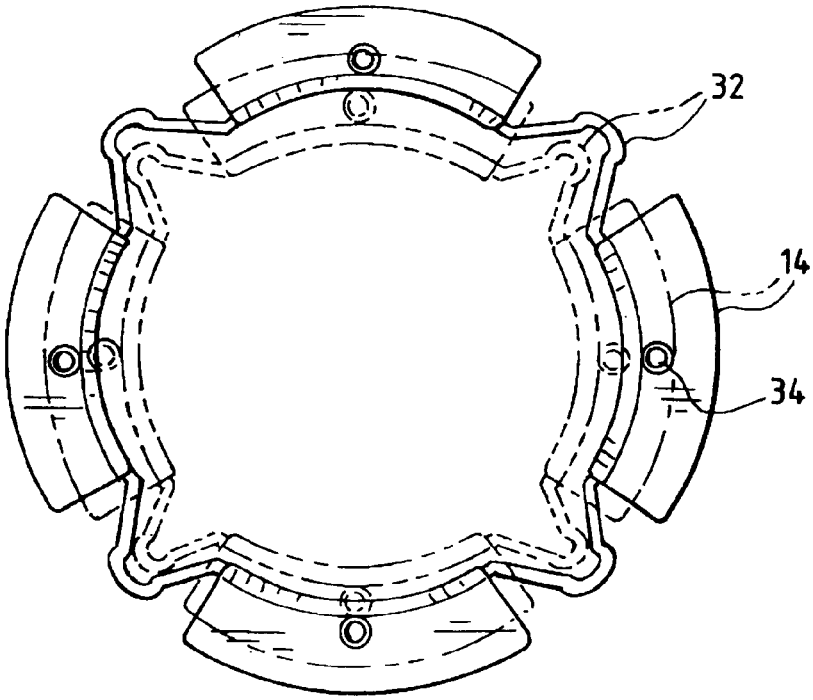
FIG. 6 is a top plan view of the keeper ring, showing how the living hinges expand as the keepers are drawn up the drain body.
Figure 7:
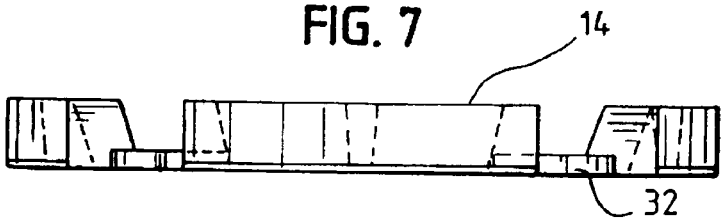
FIG. 7 is a side elevational view of the keeper ring.

FIGS. 6 and 7 show detailed views of the arcuate keepers 14. As best shown in FIG. 6, the keepers 14 preferably are connected end to end by living hinges 32, which help maintain the horizontal orientation of the keepers 14. As the keepers 14 travel up the outside of the tapered portion 20 of the drain body 12, the living hinges 32 spread out in response to the increasingly larger outer diameter of the tapered portion 20. Optional ramps 36 located on the outside of the tapered portion 20 (FIGS. 1–3) may further cause the keepers 14 to spread out.

The keepers 14 and living hinges form a ring that extends around the circumference of the drain body 12. The keepers themselves extend around almost the full circumference to provide a relatively large seating area against the underside of a shower floor. The keepers 14 have axially oriented openings 34 located about in the center of each keeper 14 for accommodating the adjusting bolts 16. Although four keepers are shown in the preferred embodiment, any number of suitable keepers may be used.

The drain body and keepers may be made from injection molded plastic or any other suitable material. The cover grate, nuts and bolts preferably are made from metal or metal alloy. The shower drain may be used as original equipment or as a replacement drain.

The shower drain 10 works in the following manner. Before use, the shower drain 10 is assembled so that the bolts extend through the apertures 26 in the flange 24 and through the openings 34 in the keepers 14. The nuts are threaded onto the bolts and held stationary within the bores 27 located on the underside of the keepers 14. The keepers 14 are in the lower (uninstalled) position. Plumber's putty, silicone or other suitable adhesive compound may be applied to the underside of the flange 24 to form a watertight seal between the flange 24 and the floor 28. Glue may be applied to the inside surface of the cylindrical portion 22 of the drain body 12 to adhere the drain 10 to the drainpipe. Next, the shower drain 10—without the cover grate 12—is inserted into an opening in the floor of a shower or other area where drainage is desired and fitted over the drainpipe.

As the adjusting bolts 16 are turned, the nuts draw the keepers 14 up the tapered portion 20 of the drain body 12 until the keepers 14 are snug against the underside of the floor. The tapered portion 20 of the shower drain body 12 guides the keepers 14 outward as they rise so the keepers 14 make better contact with the shower floor. As each keeper 14 is drawn up the tapered portion of the body 12, the living hinges 32 spread out, helping the keepers 14 to maintain maximum contact with the body 12. The bolts 16 are turned until the drain body 12 is held snug against the underside of the shower floor. The grate 18 is then positioned on top of the drain in conventional fashion.

In a second embodiment, no nuts are required, and the keepers 14 are threadably connected to the adjusting means 16. The keepers 14 travel up the outside of the tapered portion 20 of the drain 10 when the adjusting means 16 are turned.

Of course, many other modifications and other embodiments of the invention will be recognized by one skilled in the art in view of the foregoing teachings. For example, although the invention has been described as a drain for a shower, the invention may be used for any suitable drain application. Therefore the invention is not to be limited to the exact construction and operation described, and any suitable modifications are to be included within the scope of the claims allowed herein.

What is claimed is:

1. A drain for installation in a floor, the floor having a top side and an underside, the drain comprising:

a hollow body having a downstream portion, an upstream portion and a flange, the downstream portion configured to fit onto a drainpipe located underneath the floor, the upstream portion having an upper end and an outer surface that tapers outward in the upstream direction, the flange extending peripherally outward from the upper end of the upstream portion for seating against the top side of the floor;

adjusting means extending downward through apertures located in the flange; and a plurality of discrete arcuate keepers, each keeper extending partway around the circumference of the outer surface of the body upstream portion, each keeper having a flat upper surface configured to mate directly with the underside of the floor when the drain is installed, the upper surface having an opening that communicates with an axially oriented bore extending through the keeper, each keeper being operably connected to the adjusting means so that, in response to the adjusting means, each keeper can, independent of the other keepers, travel up the outer surface of the body upstream portion and engage the underside of the floor.

2. The drain of claim 1 wherein the adjusting means comprises bolts and nuts, each bolt extending downward through a flange aperture and through the axially oriented bore in each keeper, each nut threadably attached to a bolt and held stationary within a depression located on the underside of each keeper, wherein turning the bolts causes the nuts to draw the keepers up the outer surface of the body upstream portion to engage the underside of the floor.

3. The drain of claim 1 wherein the keepers extend around almost the entire circumference of the drain body.

4. The drain of claim 1 wherein the number of keepers is four and each keeper extends almost a quarter of the way around the circumference of the drain body.

5. The drain of claim 1 wherein the body is made from plastic material.

6. The drain of claim 1 wherein the body upstream portion has an inner surface tapered in the downstream direction.

7. The drain of claim 1 wherein the adjusting means comprises bolts or screws, each bolt or screw extending downward through a flange aperture, each keeper threadably attached to a bolt or screw, wherein turning the bolts or screws draws the keepers up the outer surface of the body upstream portion to engage the underside of the floor.

8. The drain of claim 1 wherein the body downstream portion has an inside wall and a lip disposed on the inside wall for abutting the drainpipe.

9. A drain for installation in a floor, the floor having a top side and an underside, the drain comprising:

a hollow body having a downstream portion, an upstream portion and a flange, the downstream portion configured to fit onto a drainpipe located underneath the floor, the upstream portion having an upper end and an outer surface that tapers outward in the upstream direction, the flange extending peripherally outward from the upper end of the upstream portion for seating against the top side of the floor;

adjusting means extending downward through apertures located in the flange; and a plurality of arcuate keepers extending circumferentially around the outer surface of the body upstream portion and operably connected to the adjusting means so that, in response to the adjusting means, the keepers travel up the outer surface of the body upstream portion and engage the underside of the floor, wherein the keepers are connected to each other by living hinges to form a ring that extends around the drain body.

10. The drain of claim 9 wherein the body downstream portion has an inside wall and a lip disposed on the inside wall for abutting the drainpipe.

11. The drain of claim 9 wherein the body upstream portion has an inner surface tapered inward in the downstream direction.

12. The drain of claim 9 wherein the adjusting means comprises bolts or screws, each bolt or screw extending downward through a flange aperture, each keeper threadably attached to a bolt or screw, wherein turning the bolts or screws draws the keepers up the outer surface of the body upstream portion to engage the underside of the floor.

* * * * *